US007347285B2

(12) United States Patent
Hamner

(10) Patent No.: US 7,347,285 B2
(45) Date of Patent: Mar. 25, 2008

(54) DRILLING MACHINE HAVING A MOVABLE ROD HANDLING DEVICE AND A METHOD FOR MOVING THE ROD HANDLING DEVICE

(75) Inventor: Jeffrey W. Hamner, Allen, TX (US)

(73) Assignee: Atlas Copco Drilling Solutions Inc., Garland, TX (US)

( * ) Notice: Subject to any disclaimer, the term of this patent is extended or adjusted under 35 U.S.C. 154(b) by 331 days.

(21) Appl. No.: 11/024,997

(22) Filed: Dec. 29, 2004

(65) Prior Publication Data

US 2006/0137910 A1 Jun. 29, 2006

(51) Int. Cl.
*E21B 1/02* (2006.01)

(52) U.S. Cl. ..... 175/122; 175/162; 175/203; 175/220

(58) Field of Classification Search ..... 175/52, 175/85, 121, 122, 220, 203, 163, 113
See application file for complete search history.

(56) References Cited

U.S. PATENT DOCUMENTS 3,682,259 A 8/1972 Cintract et al.
3,817,412 A 6/1974 Mercier et al.
4,605,077 A 8/1986 Boyadjieff
4,625,796 A 12/1986 Boyadjieff
4,787,244 A 11/1988 Mikolajczyk
4,793,422 A * 12/1988 Krasnov ..... 175/57
4,901,805 A 2/1990 Ali-Zade et al.
5,423,390 A 6/1995 Donnally et al.
5,575,344 A 11/1996 Wireman
5,941,324 A * 8/1999 Bennett ..... 175/85
6,443,241 B1 * 9/2002 Juhasz et al. ..... 175/52
6,550,128 B1 4/2003 Lorenz

* cited by examiner

*Primary Examiner*—David Bagnell
*Assistant Examiner*—Brad Harcourt
(74) *Attorney, Agent, or Firm*—Michael Best & Friedrich LLP

(57) ABSTRACT

A drilling machine including a frame, a tower, a rotary head, and a rod handling device. The frame is supported for movement over the ground and the tower is mounted on the frame. The rotary head is movable along the tower and is engageable with the drill string for rotating the drill string. The rod handling device is movable along the tower and operable to selectively support the drill string. The rod handling device is biased to a first position along the tower.

35 Claims, 6 Drawing Sheets

DRILLING MACHINE HAVING A MOVABLE ROD HANDLING DEVICE AND A METHOD FOR MOVING THE ROD HANDLING DEVICE

BACKGROUND

The invention relates to drilling machines, and more particularly, to drilling machines having a movable rod handling device.

Drilling machines typically include a frame, a tower, and a rotary head. The frame is supported for movement over the ground, and the tower is mounted on the frame. The tower defines a longitudinal axis and includes elongated members, or chords, that extend parallel to the longitudinal axis. The rotary head is movable along the tower and is engageable with a drill string for rotating the drill string. The drill string is assembled from multiple drill rods.

The rotary head includes rotary head guides that are connected to opposite sides of the rotary head and that engage the elongated members to allow the rotary head to move upward and downward along the elongated members. The rotary head connects with the drill string, rotates the drill string, and forces the drill string downward to penetrate the ground and create a drilled hole.

Drilling machines also include rod handling devices that are used to hold drill rods or constrain their movement. Some rod handling devices include rod supports and rod catchers. During rod changing operations, a rod support is positioned along the tower to hold the lower, free end of a newly added drill rod to secure the drill rod while it is being threaded into the lowered drill string. During drilling operations, a rod support is positioned along the tower to provide lateral support and vibration resistance to the drill string that is being rotated by the rotary head. A rod catcher is used to keep unattached drill rods from escaping the tower.

Existing rod handling devices are generally mounted to the side of the tower for pivotal movement. For example, FIG. 1 illustrates a prior art rod support 1 that includes an arm 2 pivotably coupled to a side panel 3 of the tower 4 for movement between an operative, closed position adjacent the drill string 5 and an inoperative, open position located a distance away from the drill string 5. In the operative, closed position, the rod support 1 lies within the travel path of the rotary head 6 such that the closed rod support 1 interferes with the movement of the rotary head 6. In the past, interlock control systems have been used to avoid collisions between the vertically-moving rotary head and the rod support in the operative position. This known swinging-arm design imparts increased strain to the side panel 3 of the tower 4 because of the unique loading caused by the operation of the swinging arm 2.

SUMMARY

The rod handling device of the present invention eliminates the potential for a damaging collision between the rotary head and the rod support arm, eliminates the need for any control system to prevent a collision, and improves the reliability of operating the rod handling device.

One embodiment of the present invention is directed to a drilling machine for use with a drill string. The drilling machine includes a frame, a tower, a rotary head, and a rod handling device. The frame is supported for movement over the ground and the tower is mounted on the frame. The rotary head is movable along the tower and is engageable with the drill string for rotating the drill string. The rod handling device is movable along the tower and is biased in a first direction toward the rotary head.

Another embodiment of the present invention is directed to a method for moving a rod handling device along a portion of a tower mounted to a frame of a drilling machine. The method includes providing a rotary head that is movable along the tower, positioning the rod handling device along the tower, biasing the rod handling device in a first direction toward the rotary head, moving the rotary head along the tower, and moving the rod handling device along the tower.

Some embodiments of the present invention include a drilling machine for use with a drill string. The drilling machine includes a frame, a tower, a rotary head, and a rod handling device. The frame is supported for movement over the ground. The tower is mounted on the frame and includes first and second elongated members. The rotary head is movable along the tower and engages with the drill string for rotating the drill string. The rod handling device is movable along the tower and extends between the elongated members.

Other embodiments of the present invention include a method for moving a rod handling device along a portion of a tower mounted to a frame of a drilling machine. The method includes providing a rotary head that is movable along the tower, positioning a rod handling device along the tower, moving the rotary head along the tower toward the rod handling device, and moving the rotary head and the rod handling device in tandem along the portion of the tower.

Other features and advantages of the invention will become apparent to those skilled in the art upon review of the following detailed description, claims, and drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
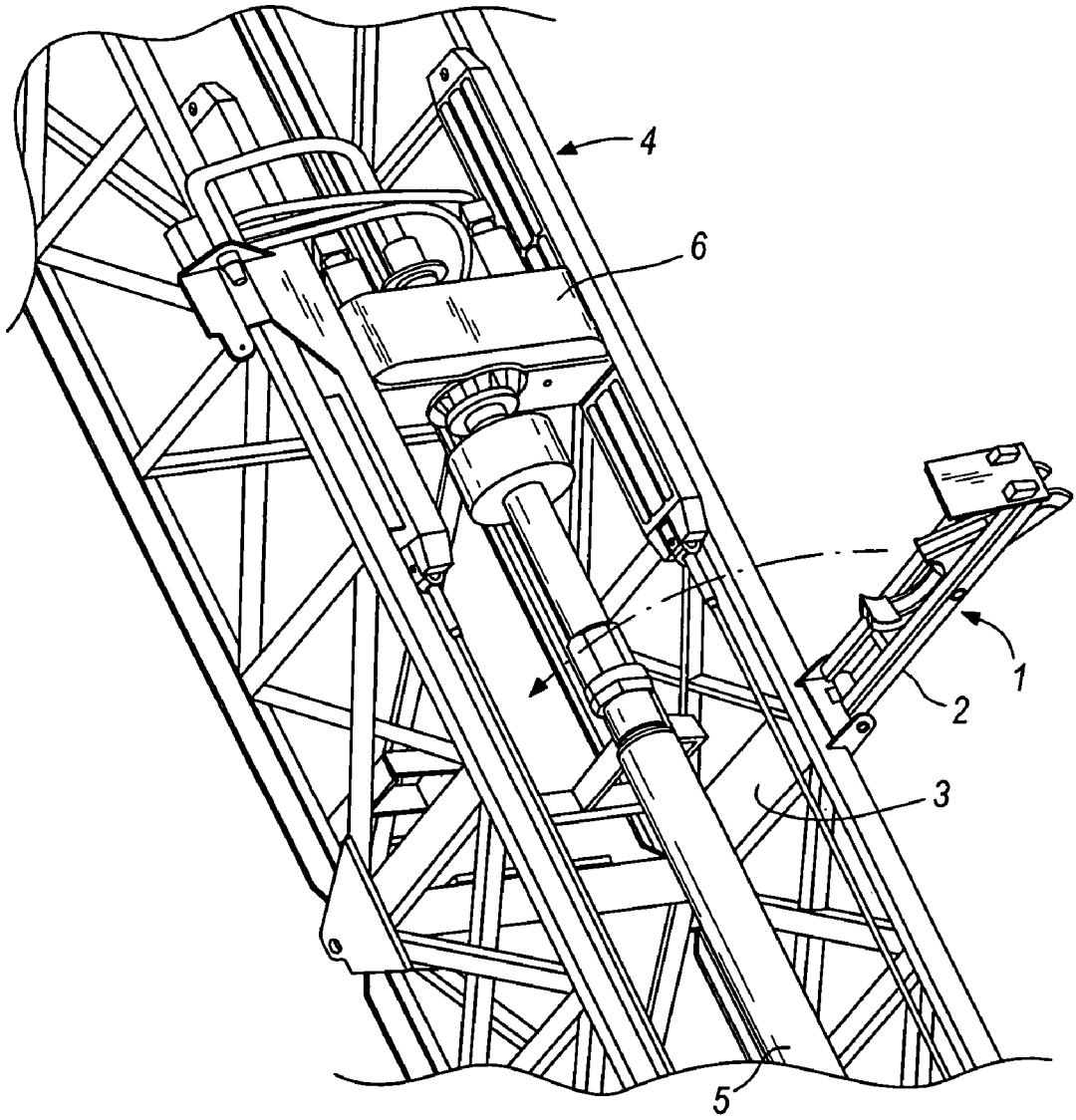
FIG. 1 PRIOR ART
FIG. 1 is a perspective view illustrating a prior art drilling machine including a pivoting rod support.
Figure 2:
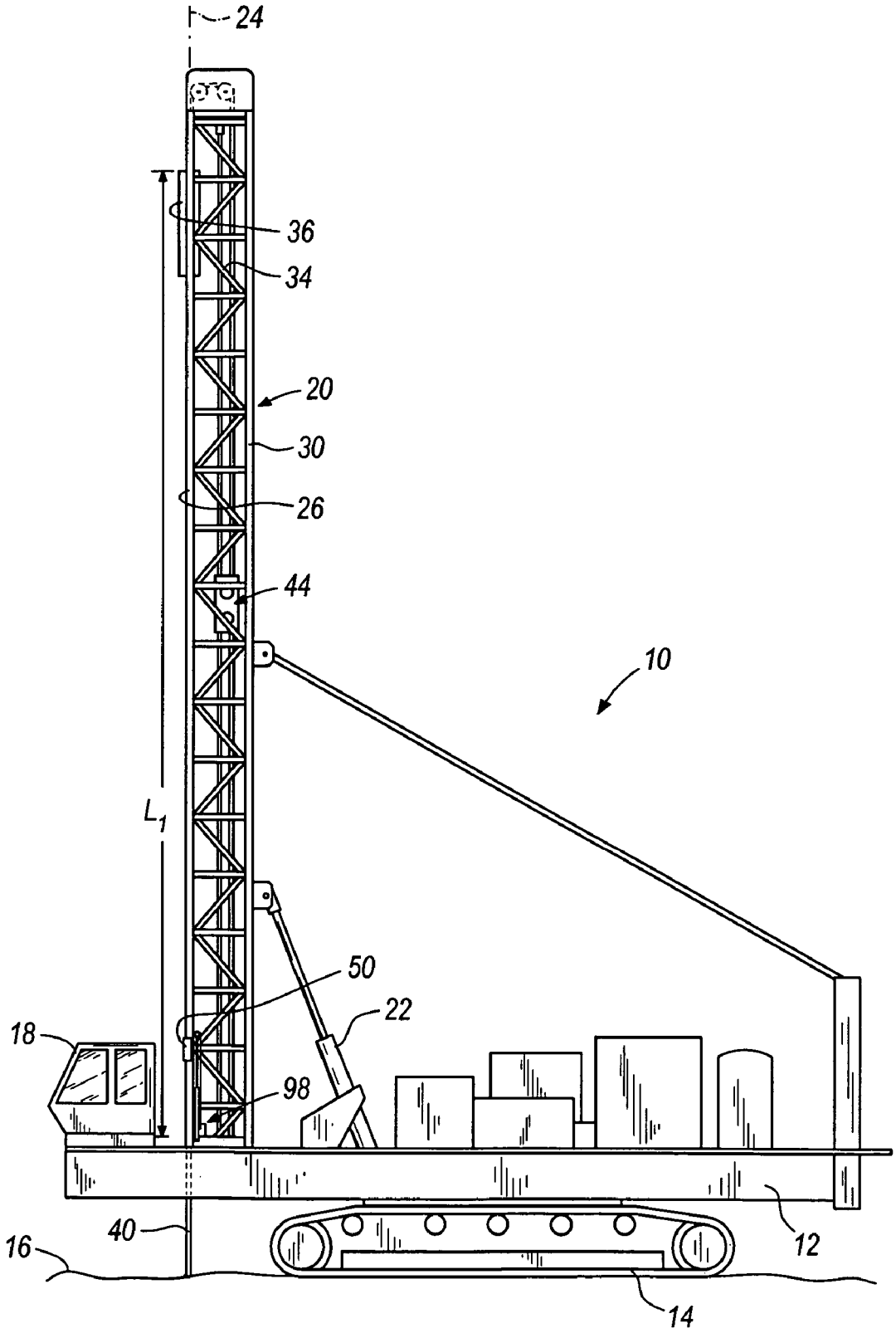
FIG. 2 is a side view illustrating a drilling machine embodying the present invention.
Figure 4:
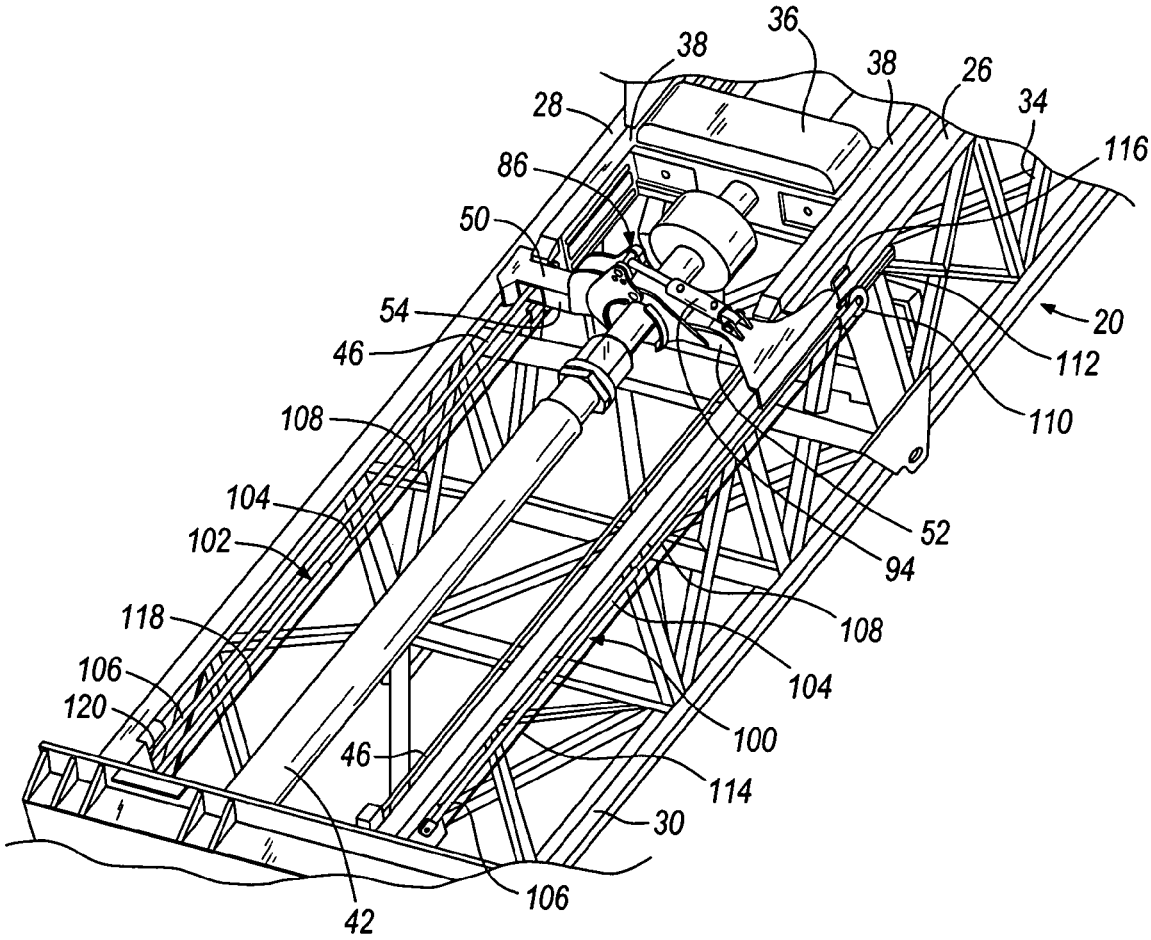
FIG. 4 is a view similar to FIG. 3 illustrating a rotary head contacting the rod support.
Figure 5:
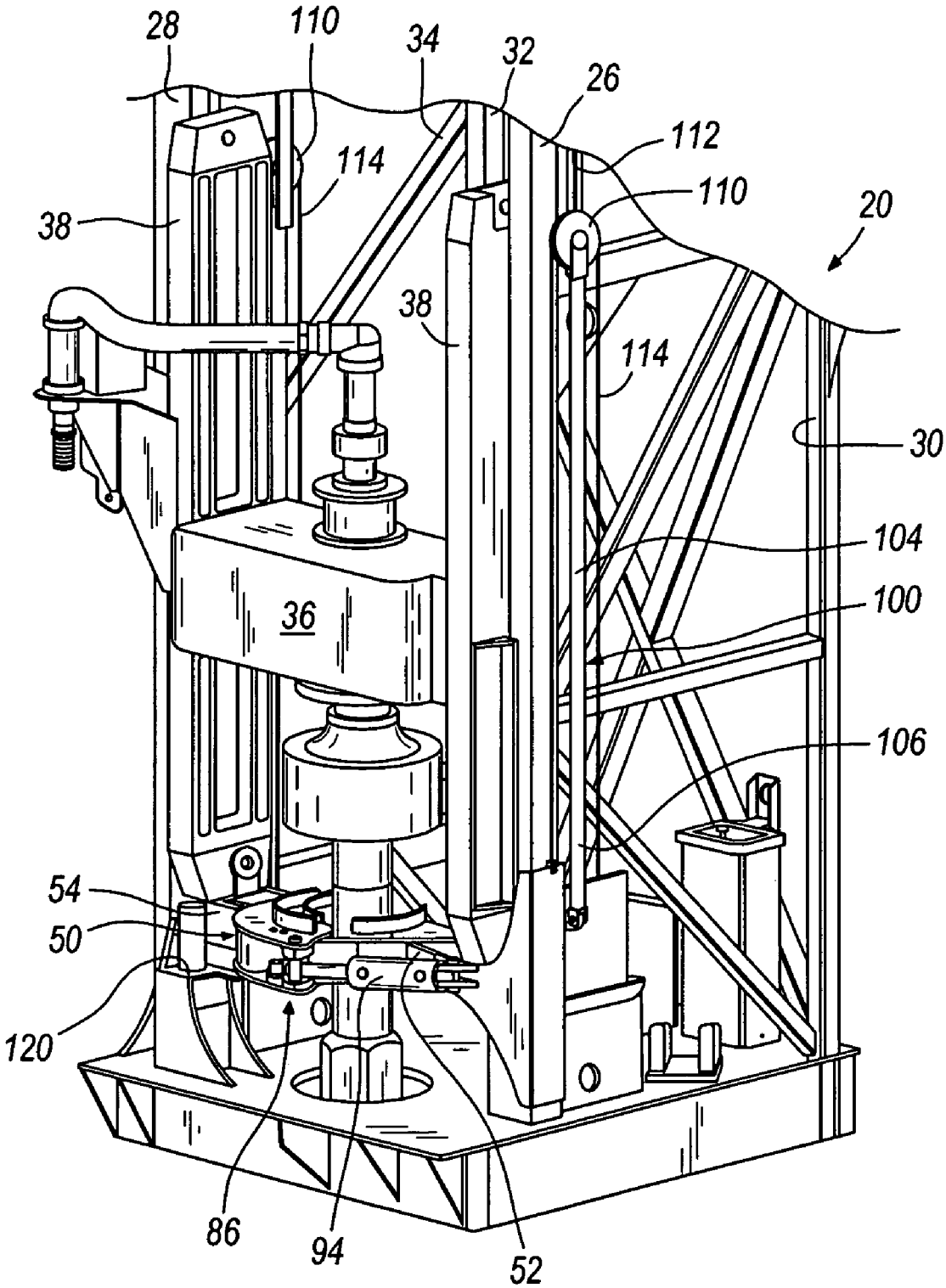
FIG. 5 is a view similar to FIG. 3 illustrating the rotary head and rod support in a lowered position.
Figure 6:
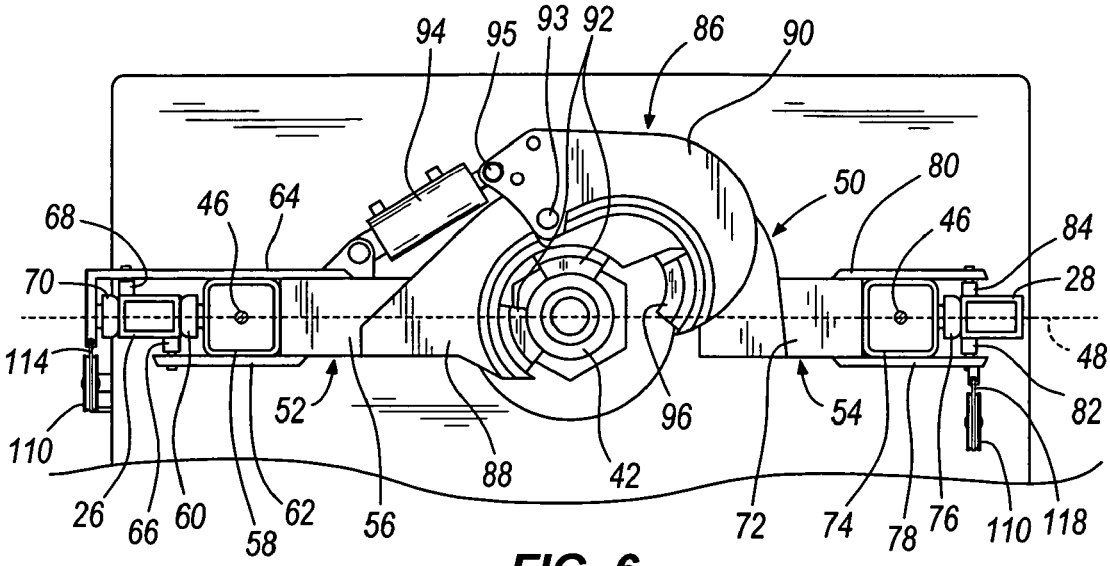
FIG. 6 is top view of the rod support shown in FIG. 3 illustrating a support clamp in the open position.
Figure 7:
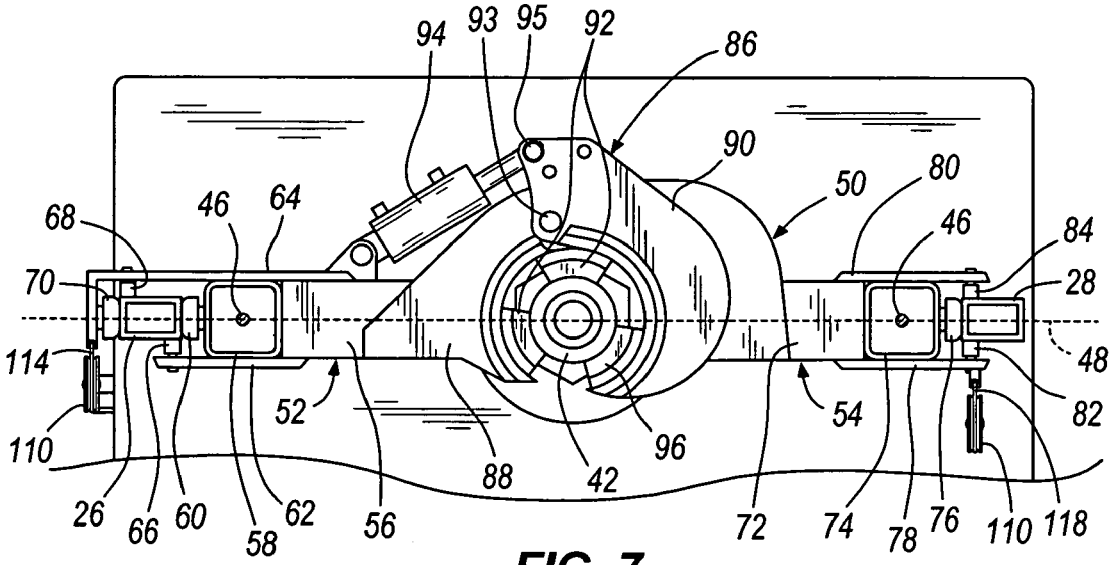
FIG. 7 is a view similar to FIG. 6 illustrating the support clamp in a closed position.

FIGS. 2-7 illustrate a drilling machine 10 embodying the present invention. With reference to FIG. 2, the drilling machine 10 includes a frame 12 that is supported by crawlers 14 for movement above the ground 16. The drilling machine 10 includes an operator station 18 located on the front of the frame 12 and a tower 20 pivotally mounted on the frame 12. The tower 20 is sometimes referred to as a derrick or mast and is movable relative to the frame 12 between a substantially vertical position and a non-vertical position by a tower lift cylinder 22. Varying the position of the tower 20 varies the angle of drilling, as is known in the art. The top of the tower 20 is generally referred to as the crown and the bottom of the tower 20 is generally referred to as the tower base. The tower 20 defines a longitudinal axis 24 and includes two forward elongated members, or chords 26, 28, and two rearward chords 30, 32 (see FIG. 5). The chords 26, 28, 30, 32 are connected together and supported by truss members 34 along the tower 20. The chords 26, 28, 30, 32 extend in a direction parallel to the longitudinal axis 24. The two forward chords 26, 28 define a plane 48 (FIGS. 6 and 7). Both chords 26, 28 have rectangular-shaped cross-sections, and each chord 26, 28 includes a forward face, an opposite rearward face, an inside face, and an outside face (see FIG. 6).

Figure 3:
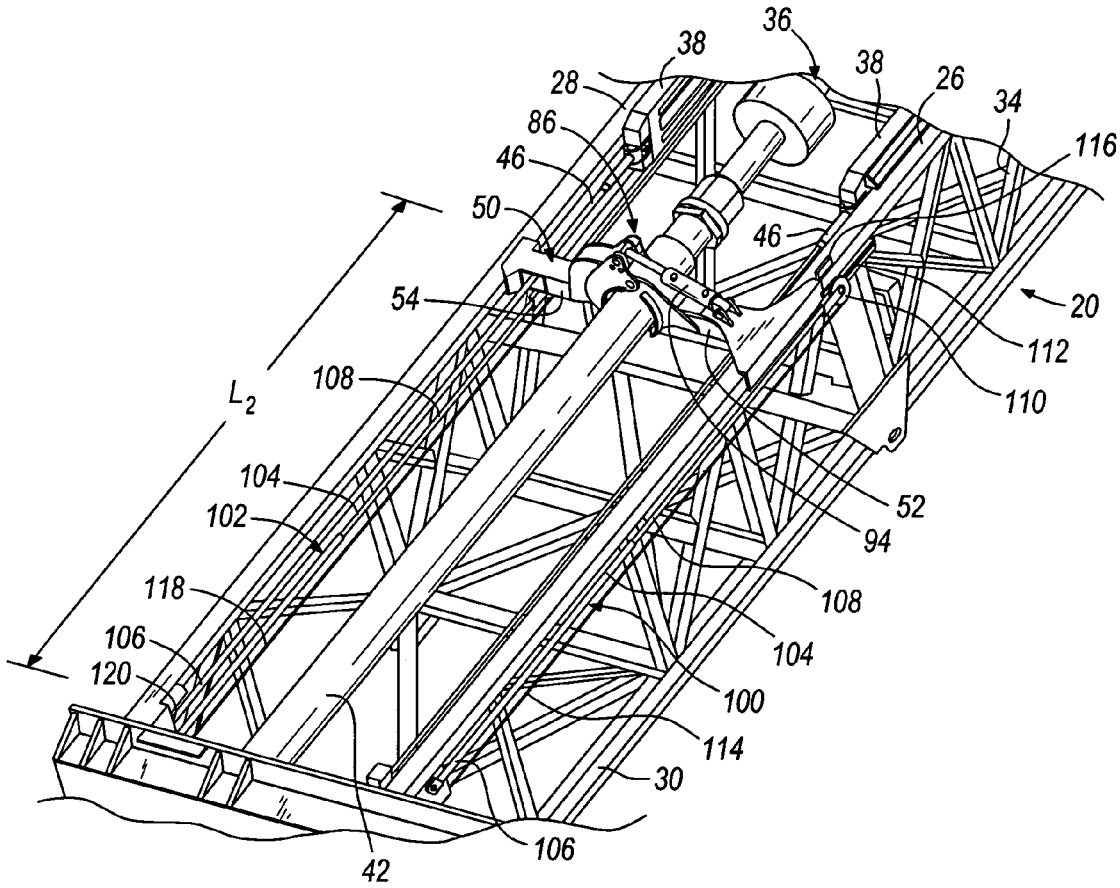
FIG. 3 is a perspective view illustrating a rod support of the drilling machine shown in FIG. 2, the rod support located in an elevated position.

With further reference to FIG. 3, the drilling machine 10 includes a rotary head 36 having rotary head guides 38. The rotary head guides 38 are slidably coupled to respective chords 26, 28. The rotary head 36 is engageable with a drill string 40 and includes a motor (not shown) that rotates the drill string 40. The drill string 40 includes multiple drill rods 42 connected in series to form a desired length. The drill string 40 extends downward from the rotary head 36, through the frame 12, and toward, or into the ground 16. The drilling machine 10 also includes a feed cable system 44 (FIG. 2) that moves the rotary head 36 along the tower 20. As the rotary head 36 rotates, the feed cable system 44 moves the rotary head 36 downward with pull-down cables 46 to force the drill string 40 into the ground 16 in order to bore or drill a hole into the ground 16. The rotary head guides 38 properly align the rotary head 36 with the tower 20 and counteract the torque forces transferred to the rotary head 36 during operation of the drilling machine 10. The feed cable system 44 also moves the rotary head 36 upwardly with pull-back cables (not shown) to remove the drill string 40 from the ground 16. Movement of the rotary head 36 along the length $L_1$ (FIG. 2) of the tower 20 defines a travel path. The travel path is generally located within the plane 48 (FIG. 6).

As shown in FIG. 3, the drilling machine 10 includes a rod support 50. Although a rod support 50 is shown and described, any other rod handling device can be used with the present invention. For example, a rod catcher can be used to keep unattached drill rods from escaping a storage area within the tower.

With further reference to FIGS. 6 and 7, the rod support 50 includes first and second support arms 52, 54 that are slidably coupled to the chords 26, 28 for movement along the tower 20. The first support arm 52 includes a beam 56 having a generally rectangular cross-section. The beam 56 includes an inward end and an outward end. The outward end of the beam 56 is connected to a collar 58 that includes a generally rectangular cross-section. The collar 58 defines a passageway that is parallel to the axis. The passageway allows the pull-down cable 46 to extend through the support arm 52. A wear pad 60 is attached to the side of the collar 58 opposite to the beam 56. The wear pad 60 engages the inside face of the chord 26 to provide a low friction contact surface between the chord 26 and the support arm 52.

The support arm 52 also includes rear and forward plates 62, 64. The rear plate 62 is connected to at least the beam 56 or the collar 58 and extends past the end of the collar 58. The rear plate 62 supports a wear pad 66 that engages the rearward face of the chord 26. The forward plate 64 is connected to at least the beam 56 or the collar 58 and has a forward portion that extends past the end of the collar 58 and an end portion that bends approximately 90 degrees around the chord 26. The forward portion supports a wear pad 68 that engages the forward face of the chord 26. The end portion supports a wear pad 70 that engages the outside face of the chord 26. The rear plate 62 includes a height that is slightly larger than the height of the beam 56 while the forward and end portions of the forward plate 64 include heights that are significantly larger than the height of the beam 56. The height of the forward plate 64 provides a larger mounting area for wear pads 68, 70 and therefore the size of the wear pads 68, 70 can be increased in at least the vertical direction. Increasing the area of the contact surfaces between the chord 26 and the wear pads 68, 70 increases the stability of the rod support 50 and improves resistance to any torque forces acting on the rod support 50.

The second support arm 54 includes a beam 72 having a generally rectangular cross-section. The beam 72 includes an inward end and an outward end. The outward end of the beam 72 is connected to a collar 74 that includes a generally rectangular cross-section. The collar 74 defines a passageway that is parallel to the axis. The passageway allows the pull-down cable 46 to extend through the support arm 54. A wear pad 76 is attached to the side of the collar 74 opposite to the beam 72. The wear pad 76 engages the inside face of the chord 28 to provide a low friction contact surface between the chord 28 and the support arm 54.

The support arm 54 also includes rear and forward plates 78, 80. The rear plate 78 is connected to at least the beam 72 or the collar 74 and extends past the end of the collar 74. The rear plate 78 supports a wear pad 82 that engages the rearward face of the chord 28. The forward plate 80 is connected to at least the beam 72 or the collar 74 and extends past the end of the collar 74. The forward plate 80 supports a wear pad 84 that engages the forward face of the chord 28. The rear and forward plates 78, 80 include heights that are slightly larger than the height of the beam 72.

The rod support 50 includes a clamp 86 having a fixed jaw portion 88 and a movable jaw portion 90. The fixed jaw portion 88 is connected between the inside ends of the beams 56, 72 and defines a C-shaped cavity opening toward the drill rod 42. Within the cavity are two grip pads 92 connected to the fixed jaw portion 88. Each grip pad 92 includes an interior face that is concave to match a corresponding portion of the diameter of the drill rod 42. The movable jaw portion 90 is pivotably connected to the fixed jaw portion 88 at a pivot axis 93. The clamp 86 includes an actuator 94 that is pivotably connected at one end to the forward plate 64 of the support arm 52 and at the other end to a second pivot axis 95 of the movable jaw portion 90. The first and second pivot axes 93, 95 are separated by a distance such that movement of the actuator 94 results in rotation of the movable jaw portion 90 to thereby open and close the clamp 86. The movable jaw portion 90 includes a C-shaped cavity opening toward the drill rod 42. The movable jaw portion 90 includes a grip pad 96 similar to the grip pads 92 of the fixed jaw portion 88. In the closed position (FIG. 7), the grip pads 92, 96 circumscribe the diameter of the drill rod 42 at three equally-spaced locations.

Referring back to FIG. 3, a counterbalance system 98 is coupled to the rod support 50 to bias the rod support 50 to a first, elevated position. The counterbalance system 98 includes counterbalance assemblies 100, 102 acting on the sides of the rod support 50. Although two counterbalance assemblies 100, 102 are illustrated and described, one or more than two counterbalance assemblies can be used with the present invention. The counterbalance assemblies 100, 102 are substantially similar and therefore only the counterbalance assembly 100 coupled to the support arm 52 will be discussed in detail.

The counterbalance assembly 100 includes a cylinder assembly. The cylinder assembly in the illustrated embodiment is a hydraulic cylinder 104, but can also be a pneumatic cylinder. The hydraulic cylinder includes a cylinder housing 106 and a shaft 108 extending from the housing 106 and slidably coupled to the housing 106. The distal end of the housing 106 is connected to the tower 20 and the distal end of the shaft 108 is attached to a pulley or sheave 110. The distal end of the shaft 108 is slidably coupled to a guide 112 along the tower 20 to restrict movement of the sheave 110 along a linear path in response to extension and retraction of the hydraulic cylinder 104. The counterbalance assembly 100 also includes a cable 114 attached at one end to the base of the tower 20, reeved around the sheave 110, and attached at the other end to the end portion of the forward plate 64. A fluid supply (not shown) maintained at a constant pressure is in fluid communication with the housing 106 to provide a constant force biasing the shaft 108 to the fully extended position to thereby raise the rod support 50 to the elevated position. The rod support 50 is stopped in the elevated position against the biasing force due to a stop 116 mounted along the chord 26. The stop 116 interferes with the forward portion of the forward plate 64 such that the rod support 50 is restrained from moving beyond the elevated position under the force of the hydraulic cylinder 104.

The counterbalance assembly 102 coupled to the other support arm 54 is similar to the counterbalance assembly 100 described above, except that it is positioned inboard of the chord 28 and one end of the cable 118 is attached to the rear plate 162 (FIG. 6). In contrast, the counterbalance assembly 100 is positioned on the outboard side of the chord 26 and the cable 114 is attached to the end portion of the forward plate 64. In the illustrated embodiment, the hydraulic cylinders 104 are fluidly connected to the same fluid supply to provide an equal biasing force to both sides of the rod support 50. In other embodiments, the biasing force of the counterbalance system 98 can be provided by springs (e.g., air springs, coil springs, resilient straps, etc) or by weights generating an upward biasing force on the rod support 50 through the force of gravity acting on the weights. Still other mechanisms can be used to provide a biasing force to the counterbalance system 100 as will be apparent to those skilled in the art in accordance with the spirit and scope of the present invention.

To operate the drilling machine 10, a first drill rod 42 is connected to the rotary head 36 when the rotary head 36 is in the uppermost position adjacent the top of the tower 20. The upper end of the drill rod 42 includes threads that mate with threads on the rotary head 36. After the first drill rod 42 is attached, the rotary head 36 begins to rotate the drill rod 42 and the pull-down cables 46 move the rotary head 36 downward until the rotating drill rod 42 contacts and breaks the surface of the ground 16.

As the rotary head 36 begins to move downward, the rod support 50 begins in the elevated position. The actuator 94 extends to move the movable jaw portion 90 into the closed position (FIG. 7) such that the clamp 86 and rod support 50 secure the drill rod 42 as it rotates and moves downward. In the closed position, the clamp 86 provides lateral support and vibration resistance to the drill rod 42 while allowing the drill rod 42 to rotate and descend. As shown in FIG. 3, the pull-down cables 46 continue to move the rotary head 36 and drill rod 42 downward to drill the hole deeper into the ground 16. As a result, the rotary head 36 moves closer to the rod support 50.

Referring to FIG. 4, when the rotary head 36 moves closer to the rod support 50 the actuator 94 will retract to rotate the movable jaw portion 90 to open the clamp 86. As the rotary head 36 continues to be lowered, the rotary head guides 38 will eventually contact the support arms 52, 54 of the rod support 50. After contacting the rod support 50, the pull-down cables 46 will continue to move the rotary head 36 downward thereby forcing the rod support 50 downward in tandem with the rod support 50 overcoming the bias force of the counterbalance system 98. Specifically, lowering the rod support 50 causes the shafts 108 to retract into the housings 106 causing fluid within the cylinders 104 to exit into the fluid supply.

The pull-down cables 46 continue to force the rotary head 36, drill rod 42, and rod support 50 to the lowermost position adjacent to the base of the tower 20 as shown in FIG. 5. At this point, the rod support 50 contacts a lower stop 120 preventing the rod support 50 from moving to a lower position. Therefore, in order to drill a deeper hole into the ground, an additional drill rod 42 must be added between the upper end of the partially submerged drill rod 42 and the rotary head 36 thereby creating a drill string 42.

To assemble the drill string 42, the rotary head 36 is disconnected from the first drill rod 42. This can be accomplished by using a breakout system (not shown) to break the threaded engagement between the rotary head 36 and the first drill rod 42. Once separated, the pull-back cables 46 raise the rotary head 36 toward the top of the tower 20. As the rotary head 36 is raised from the lowermost position, the rod support 50 will move upward under the force from the counterbalance system 98 in tandem with the rotary head 36. Specifically, the pressure of the fluid in the fluid supply extends the cylinders 104 to move the sheaves 110 upward thereby causing the cables 114, 118 to lift the rod support 50 toward the elevated position. As the rotary head 36 raises further, the rod support 50 continues to rise until it contacts the stop 116. After the rod support 50 contacts the stop 116, the rotary head 36 moves out of contact with the rod support 50 as the rotary head 36 continues to rise.

As discussed above and illustrated in FIG. 3, the rod support 50 is movable along a portion $L_2$ of length $L_1$ between the stops 116, 120. Also, the rotary head 36 and rod support 50 are movable in tandem when they are both located within this portion $L_2$. The counterbalance system avoids any potential collision between the rod support 50 and the rotary head 36 even though the rod support 50 remains within the travel path of the rotary head 36.

When the rotary head 36 returns to the uppermost position, a second, upper drill rod 42 is connected to the rotary head 36. The lower free end of the upper drill rod 42 is positioned within the cavity of the clamp 86 when the rod support 50 is in the elevated position and the clamp 86 is in the open position. The actuator 94 is extended to rotate the movable jaw portion 90 to close the clamp 86 around the lower end of the upper drill rod 42 to thereby align the lower portion of the upper drill rod 42 with the upper portion of the lower drill rod 42. The rotary head 36 then moves the ends of the drill rods 42 together and rotates the upper drill rod 42 to thread the drill rods 42 together. The drill rods 42 have mating threaded ends that are connected together by turning the rotary head 36 in a forward, drilling direction to form a joint between drill rods 42. The addition of more drill rods 42 to the drill string 40 can be accomplished in a similar manner to obtain a drill string 40 capable of reaching the desired depth of the hole to be drilled. Except for the first drill rod 42, which includes a drill point at its lowest end, each drill rod 42 includes external threads at one end and internal threads at the other end such that the drill rods 42 can be threaded together to form the drill string 40.

The drill string 40 is disassembled by raising the rotary head 36 to the top of the tower 20 and disconnecting the exposed upper drill rod 42 from the adjacent lower drill rod 42 with the breakout system, for example, located near the base of the tower 20. The non-impact breakout system breaks the threaded joint between the upper and lower drill rods 42 such that the upper drill rod 42 can be removed from the rotary head 36 and the drill string 40. The rotary head 36 is then lowered and connected to the upper end of the remaining lower drill rod 42 and the procedure is repeated until the entire drill string 40 is removed.

Various features and advantages of the invention are set forth in the following claims.

What is claimed is:

1. A drilling machine for use with a drill string, the drilling machine comprising:

a frame supported for movement over the ground;

a tower mounted on the frame;

a rotary head movable along the tower, the rotary head engageable with the drill string for rotating the drill string; and a rod handling device coupled to, and movable along the tower, the rod handling device biased in a first direction toward the rotary head, the rod handling device contacting the rotary head while the rotary head is moving in a second direction opposite of the first direction, the rod handling device moving against the bias in tandem with the rotary head as the rotary head continues moving in the second direction after contacting the rod handling device.

2. The drilling machine of claim 1, wherein the rod handling device is biased by a counterweight system.

3. The drilling machine of claim 2, wherein the counterweight system includes a hydraulic cylinder coupled at one end to the tower.

4. The drilling machine of claim 3, wherein the counterweight system includes a sheave and a cable, wherein the sheave is coupled to the opposite end of the hydraulic cylinder and the cable is connected at one end to the tower, is reeved around the sheave, and is connected at the opposite end to the rod handling device.

5. The drilling machine of claim 4, wherein the counterweight system includes a guide, the hydraulic cylinder being coupled to the guide for linear movement of the sheave.

6. The drilling machine of claim 1, wherein the rotary head forces the rod handling device in the second direction when the rotary head moves in the second direction along a portion of the tower.

7. The drilling machine of claim 1, wherein the rotary head allows the rod handling device to move in the first direction when the rotary head moves in the first direction along the portion of the tower.

8. The drilling machine of claim 1, wherein the first direction is an upward direction.

9. The drilling machine of claim 1, wherein the movement of the rotary head along the tower defines a travel path, the rod handling device remaining within the travel path during movement of the rotary head along the entire travel path.

10. The drilling machine of claim 1, wherein the drilling machine includes a stop restricting the rod handling device from moving past a first position in the first direction.

11. A method for moving a rod handling device along a portion of a tower mounted to a frame of a drilling machine, the method comprising:

providing a rotary head that is movable along the tower;

coupling a rod handling device to the tower;

biasing the rod handling device in a first direction toward the rotary head;

moving the rotary head along the tower in a second direction opposite the first direction;

contacting the rotary head against the rod handling device; and moving the rotary head and the rod handling device in tandem as the rotary head continues moving against the bias in the second direction after contacting the rod handling device, along the tower.

12. The method of claim 11, wherein biasing the rod handling device in a first direction includes biasing the rod handling device in an upward direction.

13. The method of claim 11, further comprising moving the rotary head and the rod handling device in tandem along the portion of the tower.

14. The method of claim 11, further comprising:

moving the rotary head in a second direction opposite to the first direction; and forcing the rod handling device with the rotary head in the second direction along the portion of the tower.

15. The method of claim 11, further comprising:

moving the rotary head in the first direction; and allowing the rod handling device to move in the first direction along the portion of the tower.

16. The method of claim 15, further comprising stopping movement of the rod handling device in the first direction along the portion of the tower at a first position.

17. The method of claim 11, further comprising:

defining a travel path by movement of the rotary head along the tower; and maintaining the rod handling device within the travel path during movement of the rotary head along the entire travel path.

18. A drilling machine for use with a drill string, the drilling machine comprising:

a frame supported for movement over the ground;

a tower mounted on the frame, the tower including first and second elongated members;

a rotary head movable along the tower and coupled to the first and the second elongated members such that the first and the second elongated members guide movement of the rotary head along the tower, the rotary head engageable with the drill string for rotating the drill string; and a rod handling device movable along the tower, the rod handling device extending between, and coupled to the first and the second elongated members, wherein the rotary head is movable into contact with the rod handling device.

19. The drilling machine of claim 18, wherein the rod handling device is movable along the tower while the rod handling device extends between the elongated members.

20. The drilling machine of claim 18, wherein the rotary head and the rod handling device are movable in tandem along a portion of the tower.

21. The drilling machine of claim 20, wherein the rotary head forces the rod handling device in a first direction along the portion of the tower.

22. The drilling machine of claim 20, wherein the rotary head allows the rod handling device to move in a second direction opposite to the first direction along the portion of the tower.

23. The drilling machine of claim 22, wherein the drilling machine includes a stop restricting the rod handling device from moving in the second direction.

24. The drilling machine of claim 18, wherein the rod handling device is a rod support including a clamp selectively engageable with the drill string.

25. The drilling machine of claim 18, wherein the movement of the rotary head along the tower defines a travel path, the rod handling device remaining within the travel path during movement of the rotary head along the entire travel path.

26. A method for moving a rod handling device along a portion of a tower mounted to a frame of a drilling machine, the method comprising:

providing a rotary head that is movable along the tower;

coupling a rod handling device to the tower;

moving the rotary head along the tower toward the rod handling device;

moving the rotary head and the rod handling device in tandem along the portion of the tower; and biasing the rod handling device toward a first position.

27. The method of claim 26, further comprising:

moving the rotary head in a first direction; and forcing the rod handling device with the rotary head in the first direction along the portion of the tower.

28. The method of claim 27, further comprising:

moving the rotary head in a second direction opposite to the first direction; and allowing the rod handling device to move in the second direction along the portion of the tower.

29. The method of claim 28, further comprising stopping movement of the rod handling device in the second direction with a stop.

30. The method of claim 26, further comprising:

defining a travel path by movement of the rotary head along the tower; and maintaining the rod handling device within the travel path during movement of the rotary head along the entire travel path.

31. A drilling machine for use with a drill string, the drilling machine comprising:

a frame supported for movement over the ground;

a tower mounted on the frame, the tower including first and second elongated members;

a rotary head movable along the tower and coupled to the first and the second elongated members such that the first and the second elongated members guide movement of the rotary head along the tower, the rotary head engageable with the drill string for rotating the drill string; and a rod handling device movable along the tower, the rod handling device extending between, and coupled to the first and the second elongated members, wherein the rod handling device is biased by a counterweight system.

32. The drilling machine of claim 31, wherein the counterweight system includes a hydraulic cylinder coupled at one end to the tower.

33. The drilling machine of claim 32, wherein the counterweight system includes a sheave and a cable, wherein the sheave is coupled to the opposite end of the hydraulic cylinder and the cable is connected at one end to the tower, is reeved around the sheave, and is connected at the opposite end to the rod handling device.

34. The drilling system of claim 33, wherein the counterweight system includes a guide, the hydraulic cylinder being coupled to the guide for linear movement of the sheave.

35. A method for moving a rod handling device along a portion of a tower mounted to a frame of a drilling machine, the method comprising:

providing a rotary head that is movable along the tower;

coupling a rod handling device to the tower;

moving the rotary head along the tower toward the rod handling device;

moving the rotary head and the rod handling device in tandem along the portion of the tower; and contacting the rod handling device with the rotary head.

* * * * *